US009863328B2

(12) United States Patent
Muramatsu

(10) Patent No.: US 9,863,328 B2
(45) Date of Patent: Jan. 9, 2018

(54) EXHAUST PIPE VALVE SYSTEM OF INTERNAL COMBUSTION ENGINE

(71) Applicant: SUZUKI MOTOR CORPORATION, Hamamatsu-Shi, Shizuoka (JP)

(72) Inventor: Takayoshi Muramatsu, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 225 days.

(21) Appl. No.: 14/842,159

(22) Filed: Sep. 1, 2015

(65) Prior Publication Data

US 2016/0069278 A1 Mar. 10, 2016

(30) Foreign Application Priority Data

Sep. 4, 2014 (JP) ..... 2014-180298

(51) Int. Cl.

| | |
|---|---|
| ***F01N 1/00*** | (2006.01) |
| ***F02D 9/04*** | (2006.01) |
| ***F01N 13/08*** | (2010.01) |
| ***F02D 9/10*** | (2006.01) |

(52) U.S. Cl.

CPC ..... *F02D 9/04* (2013.01); *F01N 13/08* (2013.01); *F02D 9/109* (2013.01); *F02D 9/1065* (2013.01); *F01N 2240/36* (2013.01); *F01N 2390/02* (2013.01); *F01N 2390/08* (2013.01); *F01N 2590/04* (2013.01)

(58) Field of Classification Search

CPC ..... F02D 9/04; F02D 9/1065; F02D 9/109; F01N 13/08

USPC ..... 60/324

See application file for complete search history.

(56) References Cited

U.S. PATENT DOCUMENTS

| | | | | |
|---|---|---|---|---|
| 2001/0027648 | A1 | 10/2001 | Nakayasu et al. | |
| 2001/0035009 | A1 | 11/2001 | Nakayasu et al. | |
| 2011/0061616 | A1* | 3/2011 | Watanabe | F01L 1/02 123/90.15 |
| 2013/0205760 | A1* | 8/2013 | Sasaki | F01N 13/08 60/324 |

FOREIGN PATENT DOCUMENTS

| | | |
|---|---|---|
| JP | 4015353 (B2) | 11/2007 |

* cited by examiner

*Primary Examiner* — Jason Shanske

(74) *Attorney, Agent, or Firm* — Troutman Sanders LLP

(57) ABSTRACT

An exhaust pipe valve system of an internal combustion engine includes: a plurality of exhaust pipe valves; and an actuator unit being an operation unit which performs an opening/closing operation of the exhaust pipe valves, wherein: the operation unit includes a first pulley and a second pulley being at least two operation parts which are connected to the plural exhaust pipe valves via wire cables respectively to open/close the exhaust pipe valves; and at least one of the operation parts has a non-operating area in which the operation part does not cause the corresponding cable to work in a predetermined operating range of the operation unit.

3 Claims, 11 Drawing Sheets

13
14
15
16
17
19
20
26
27
α
β

EXHAUST PIPE VALVE SYSTEM OF INTERNAL COMBUSTION ENGINE

CROSS-REFERENCE TO RELATED APPLICATIONS

This application is based upon and claims the benefit of priority of the prior Japanese Patent Application No. 2014-180298, filed on Sep. 4, 2014, the entire contents of which are incorporated herein by reference.

BACKGROUND OF THE INVENTION

Field of the Invention

The present invention relates to an exhaust pipe valve system which performs exhaust control in an exhaust pipe in an engine being an internal combustion engine of a vehicle such as, for example, a motorcycle.

Description of the Related Art

In a vehicle of this type, an exhaust control device is disposed which improves exhaust efficiency by opening/closing an exhaust passage by an exhaust pipe valve provided in the middle of an exhaust pipe. Patent Document 1, for example, discloses one which tries to improve exhaust performance by providing an exhaust control valve in an exhaust pipe.

In a motorcycle or the like, it is also possible to provide, in an exhaust pipe, two exhaust pipe valves that operate in different engine speed ranges. Conventionally, when the two exhaust pipe valves are thus provided, these exhaust pipe valves are generally driven by electronically controlled actuators respectively. Thus providing the two exhaust pipe valves enables more proper exhaust control according to the engine speed.

Patent Document 1 Japanese Patent No. 4015353

When two exhaust pipe valves are provided as in, for example, the above-described example, it has been a conventional practice to provide independent actuators to control the driving of the respective exhaust pipe valves. Thus providing the plural actuators not only complicates the device structure but also inevitably leads to a great cost increase.

SUMMARY OF THE INVENTION

In consideration of the above circumstances, it is an object of the present invention to provide an exhaust pipe valve system of an internal combustion engine that achieves structure simplification yet realizes excellent control performance over an exhaust system.

An exhaust pipe valve system of an internal combustion engine of the present invention is an exhaust pipe valve system of an internal combustion engine which adjusts an exhaust flow rate in an exhaust pipe by opening/closing an exhaust pipe valve provided in a middle part of the exhaust pipe, the exhaust pipe valve system including: a plurality of the exhaust pipe valves; and an operation unit which performs an opening/closing operation of the exhaust pipe valves, wherein: the operation unit includes at least two operation parts which are connected to the plural exhaust pipe valves via cables respectively to open/close the exhaust pipe valves; and at least one of the operation parts has a non-operating area in which the operation part does not cause the corresponding cable to work in a predetermined operating range of the operation unit.

Further, in the exhaust pipe valve system of the internal combustion engine of the present invention, the connection between the operation part and the corresponding cable is cut off in the non-operating area of the operation part.

Further, in the exhaust pipe valve system of the internal combustion engine of the present invention, the operation part other than the operation part having the non-operating area constantly causes the corresponding cable to work in an entire operating range of the operation unit.

DETAILED DESCRIPTION OF THE PREFERRED EMBODIMENTS

Hereinafter, a suitable embodiment in an exhaust pipe valve system of an internal combustion engine according to the present invention will be described based on the drawings.

Figure 1:
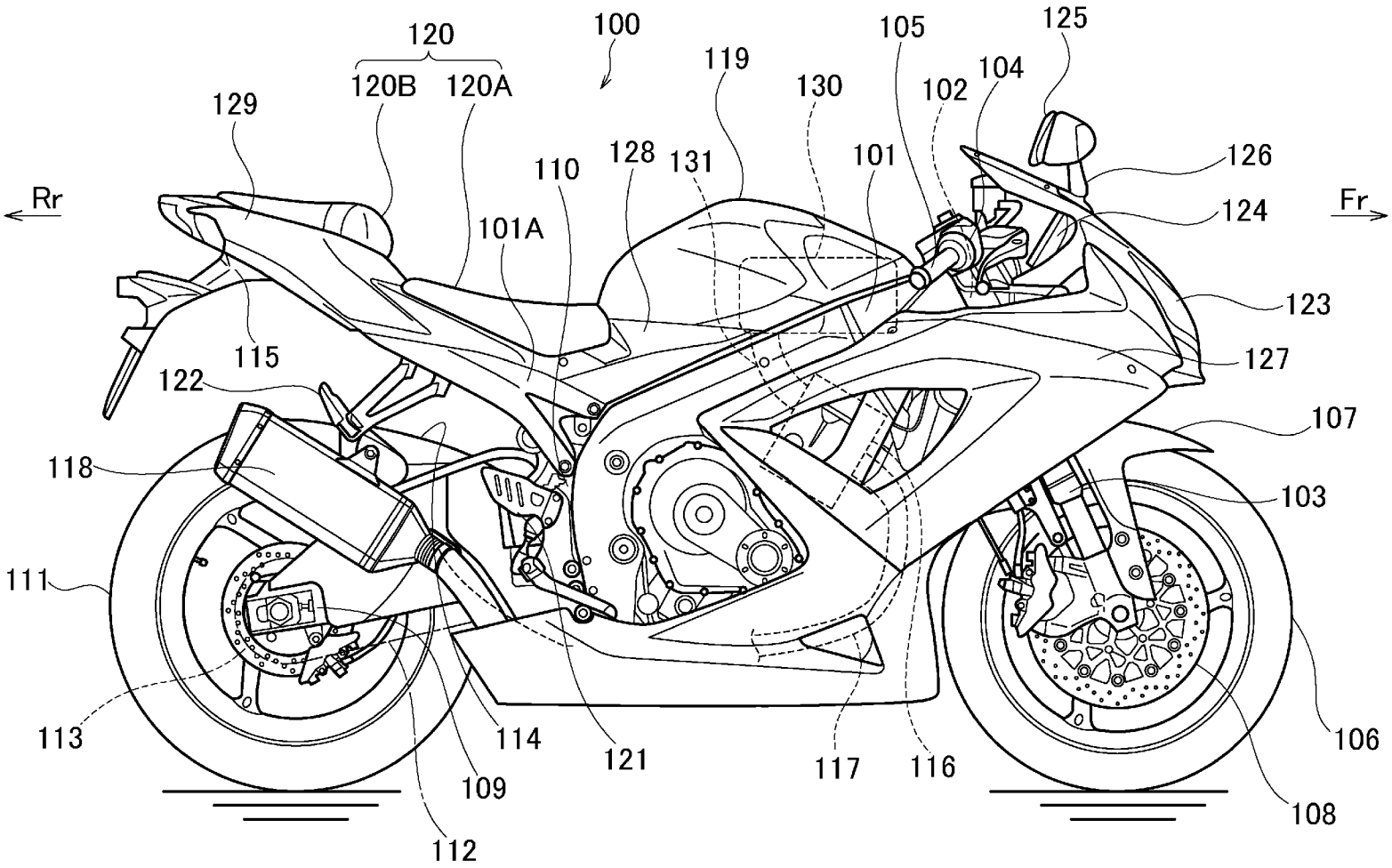
FIG. 1 is a side view illustrating the whole structure of a motorcycle according to the present invention.

FIG. 1 is a side view of a motorcycle 100 according to the present invention. First, the whole structure of the motorcycle 100 will be described by using FIG. 1. Note that, in the drawings including FIG. 1 used in the following description, a front side of the vehicle is indicated by an arrow Fr, a rear side of the vehicle is indicated by an arrow Rr, a lateral right side of the vehicle is indicated by an arrow R, and a lateral left side of the vehicle is indicated by an arrow L when required.

In FIG. 1, on a front portion of a main frame 101 made of steel or an aluminum alloy material, a pair of left and right front forks 103 which are supported by a steering head pipe 102 to be pivotable left and right are provided. On upper ends of the front forks 103, a handlebar 104 is fixed, and grips 105 are provided on both ends of the handlebar 104. On lower portions of the front forks 103, a front wheel 106 is rotatably supported, and a front fender 107 is fixed so as to cover an upper portion of the front wheel 106. A brake disk 108 which rotates together with the front wheel 106 is attached to the front wheel 106.

The main frame 101 is connected to a rear portion of the steering head pipe 102 and bifurcates rearward into a pair of left and right parts, and these parts extend while inclining more downward as they go more rearward. A seat rail 101A extends from the vicinity of a rear portion of the main frame 101 while moderately inclining more upward as it goes rearward, to support a later-described seat. The main frame 101 and the seat rail 101A form a body frame. Further, a swing arm 109 is coupled to the rear portion of the main frame 101 so as to be swingable, and a rear shock absorber 110 is mounted between the main frame 101 and the swing arm 109. A rear wheel 111 is rotatably supported on a rear end of the swing arm 109. The rear wheel 111 is driven to rotate via a driven sprocket 113 around which a chain 112 for transmitting motive power of a later-described engine is wound. An inner fender 114 covering the vicinity of a front upper portion of the rear wheel 111 is provided in the immediate vicinity of the rear wheel 111, and a rear fender 115 is disposed above the inner fender 114.

An engine unit 116 (the dotted-line part in FIG. 1) mounted on the main frame 101 is supplied with an air-fuel mixture in which a fuel from a not-illustrated fuel supply device and the air from an air cleaner are mixed. Exhaust gas after combustion in the engine is discharged through exhaust pipes 117. In this embodiment, the engine may be, for example, a four-cycle multi-cylinder, typically, four-cylinder engine. The exhaust pipes 117 of respective cylinders join under the engine unit 116. After passing through the exhaust pipes 117, the exhaust gas is discharged from a muffler 118 supported on the vicinity of a rear portion on a vehicle right side.

Further, a fuel tank 119 is mounted above the engine unit 116, and the seat 120 is provided continuously from and behind the fuel tank 119. The seat 120 includes a rider seat 120A and a tandem seat 120B. A footrest 121 and a footrest or a pillion step 122 are disposed so as to correspond to the rider seat 120A and the tandem seat 120B. Incidentally, in this example, the vehicle has, on its left side, a not-illustrated prop stand provided on a lower portion at a substantially center in terms of a front and rear direction.

Further, in FIG. 1, 123 denotes a headlamp, 124 denotes a meter unit including a speedometer, a tachometer, various kinds of indicator lamps, or the like, and 125 denotes a rearview mirror supported by the handlebar 104 via a stay 126.

In the vehicle exterior, mainly a front portion and side portions of the vehicle are covered by a fairing 127 and a side cowl 128, and a side cover or a seat cowl 129 is attached on the rear portion of the vehicle. These exterior members form a vehicle outer form having what is called a streamlined shape.

Incidentally, as illustrated in FIG. 1, the fuel tank 119 having a dome shape or a carapace shape is mounted on and supported by the main frame 101 so as to cover the entire upper side of the main frame 101 from above. Further, the air cleaner 130 to supply the purified air to an intake device is disposed above the engine unit 116. The air purified by the air cleaner 130 is taken in by the intake device, thereafter, as illustrated in FIG. 1, the fuel is mixed therewith in an intake pipe 131, and the resultant mixture is supplied as the air-fuel mixture to the engine unit 116.

Figure 2:
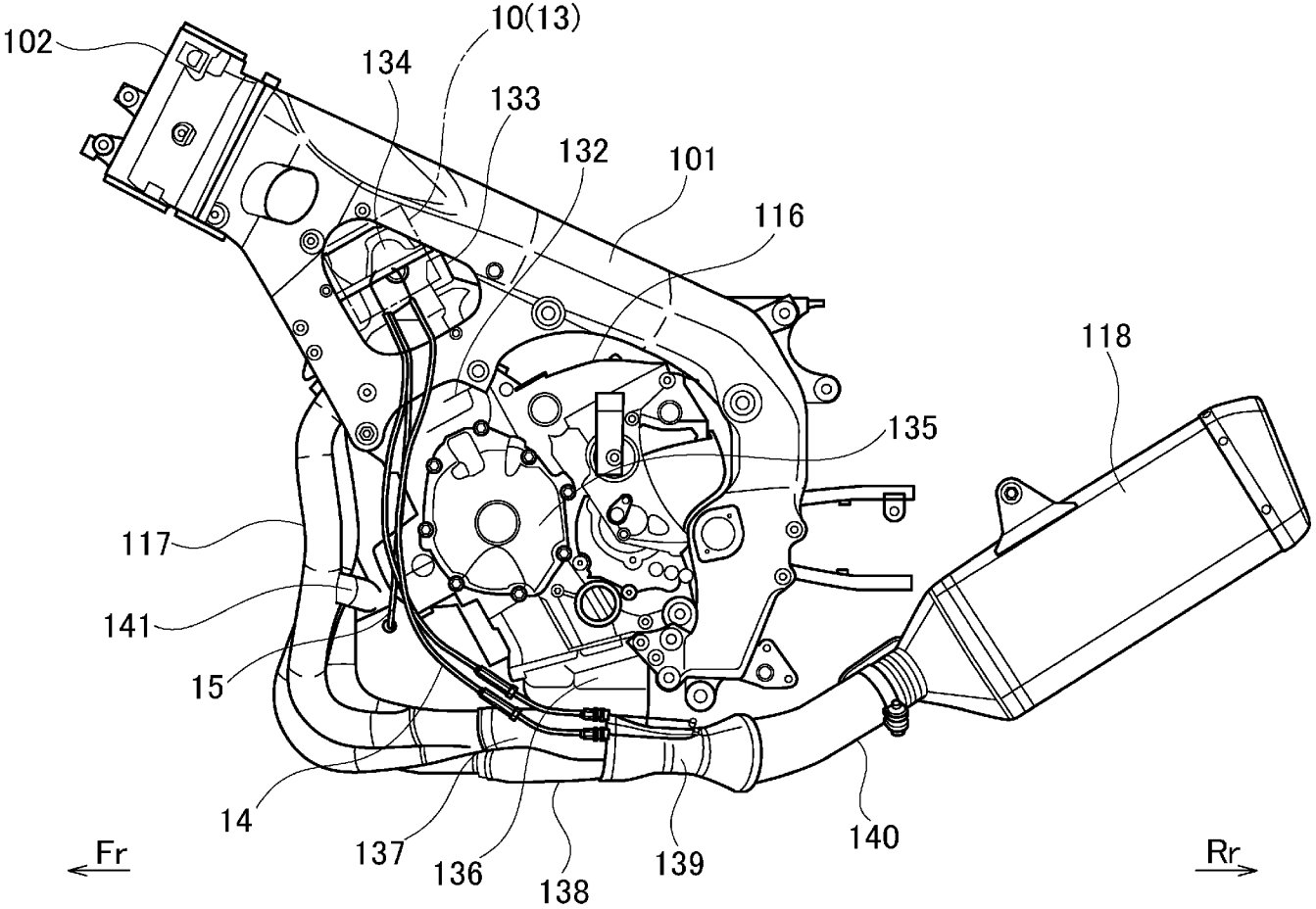
FIG. 2 is a side view illustrating a concrete structure example of the vicinity of an engine unit in an embodiment of the present invention.
Figure 3:
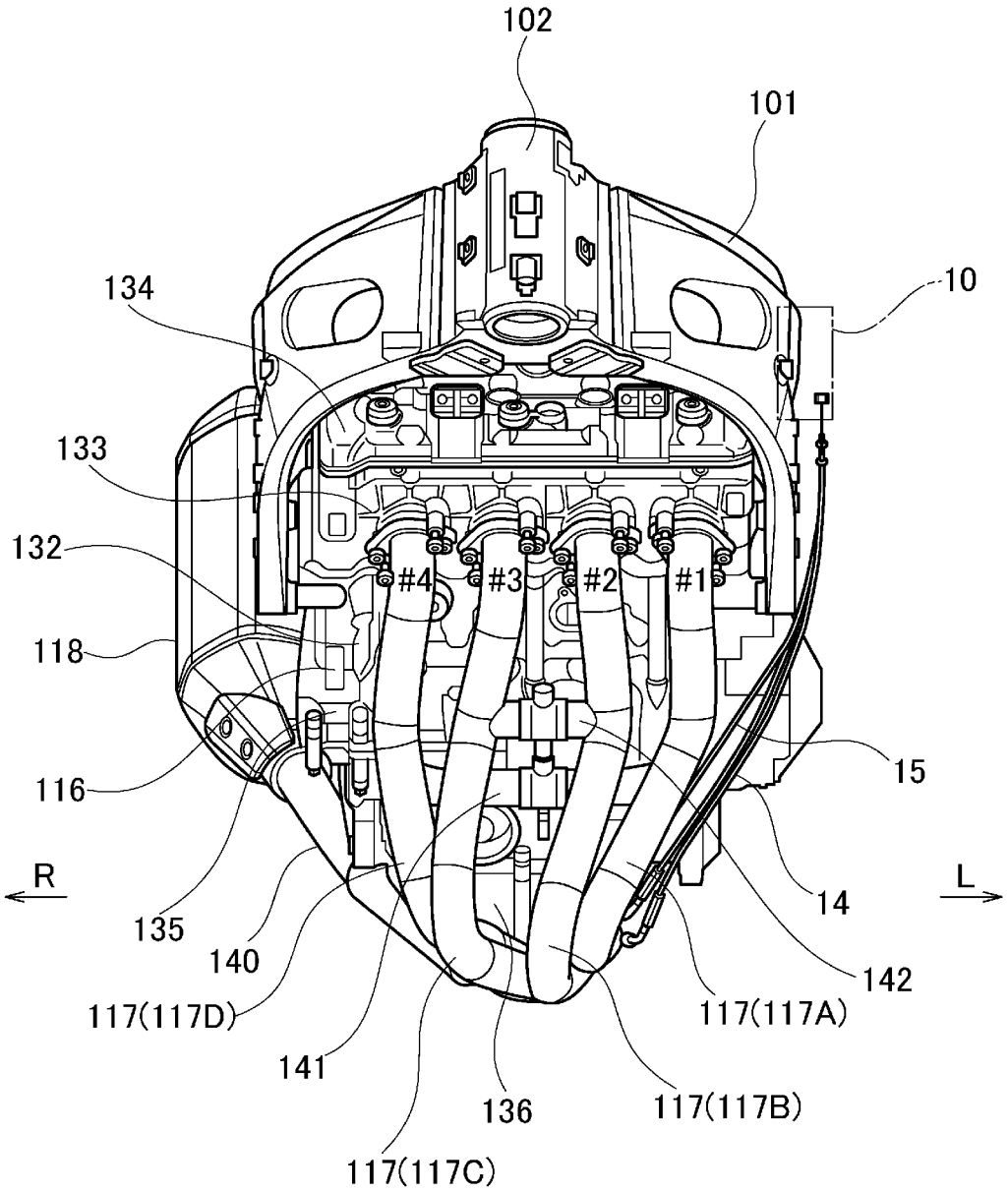
FIG. 3 is a front view illustrating the concrete structure example of the vicinity of the engine unit in the embodiment of the present invention.

Next, FIG. 2 and FIG. 3 illustrate a concrete structure example of the vicinity of the engine unit 116 in this embodiment. In the engine unit 116 which is a parallel four-cylinder type in this example, a cylinder head 133 and a cylinder head cover 134 are coupled in the order mentioned on an upper side of a cylinder block 132 disposed so as to incline forward, and under the cylinder block 132, a crankcase 135 is integrally coupled. Further, on a lower portion of the crankcase 135, an oil pan 136 is attached. As for the cylinder arrangement of the engine unit 116, the cylinders will be referred to as a #1 cylinder, a #2 cylinder, a #3 cylinder, and a #4 cylinder in order from left toward right. The engine unit 116 is suspended on the main frame 101 via a plurality of engine mounts to be thereby integrally coupled to the main frame 101, and the engine unit 116 itself acts as a rigid member of the main frame 101.

Here, the exhaust pipe 117 of the #1 cylinder and the exhaust pipe 117 of the #2 cylinder join at a junction part 137, and the exhaust pipe 117 of the #3 cylinder and the exhaust pipe 117 of the #4 cylinder joint at a junction part 138. Further, the junction part 137 and the junction part 138 join each other, so that the four exhaust pipes 117 of the #1 to #4 cylinders are collected to a single collecting pipe 139 substantially on a lower left of the oil pan 136. The collecting pipe 139 is connected to the muffler 118 via a connecting pipe 140. As will be described later, an exhaust pipe valve according to the exhaust pipe valve system of the present invention is fit in the collecting pipe 139.

Further, the left and right-end exhaust pipes 117 (117A, 117D) of the #1 and #4 cylinders communicate with each other via a communication pipe 141. The communication pipe 141 is horizontally disposed between rear sides of the left and right-end exhaust pipes 117. The exhaust pipes 117 (117B, 117C) of the #2 and #3 cylinders communicate with each other via a communication pipe 142. The communication pipe 142 is disposed so as to be sandwiched between the exhaust pipes 117 of the #2 and #3 cylinders and is disposed so as to be located on a diagonally front upper side of the communication pipe 141. As will be described later, exhaust pipe valves according to the exhaust pipe valve system of the present invention are fit in the communication pipe 141 and the communication pipe 142.

An exhaust system which is from the exhaust pipes 117 (117A to 117D) through the junction part 137 and the junction part 138 and then from the collecting pipe 139 up to the muffler 118 via the connecting pipe 140 is formed, as described above. Further, the exhaust pipe valve system including an exhaust control device 10 to perform exhaust control of this exhaust system is provided. The exhaust control device 10 has at least two kinds of exhaust pipe valves which perform the exhaust control at different parts in such an exhaust system, and drives the opening/closing of these exhaust pipe valves by a single actuator.

Figure 4:
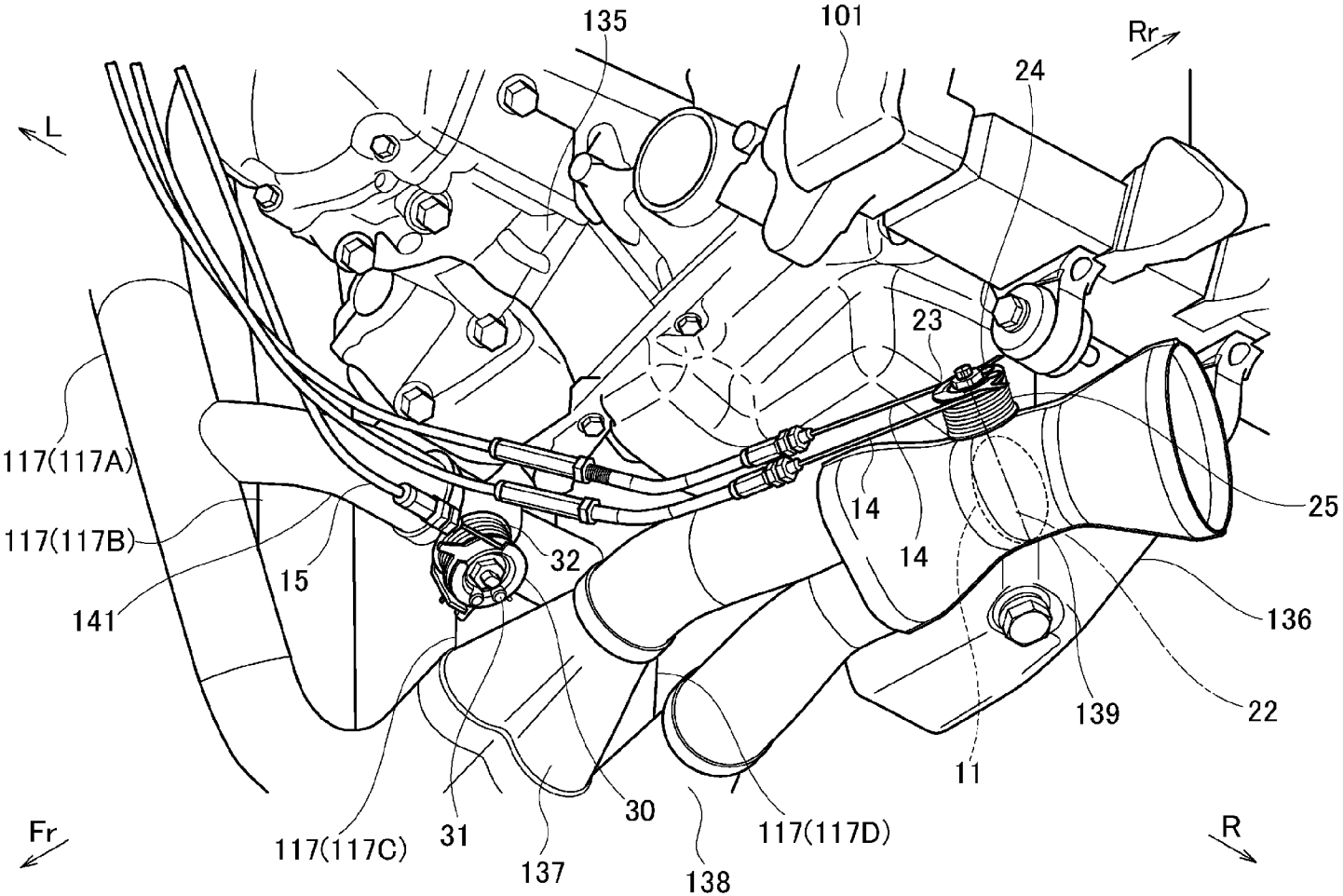
FIG. 4 is a perspective view illustrating an example of a control target of an exhaust control device in the embodiment of the present invention.
Figure 5:
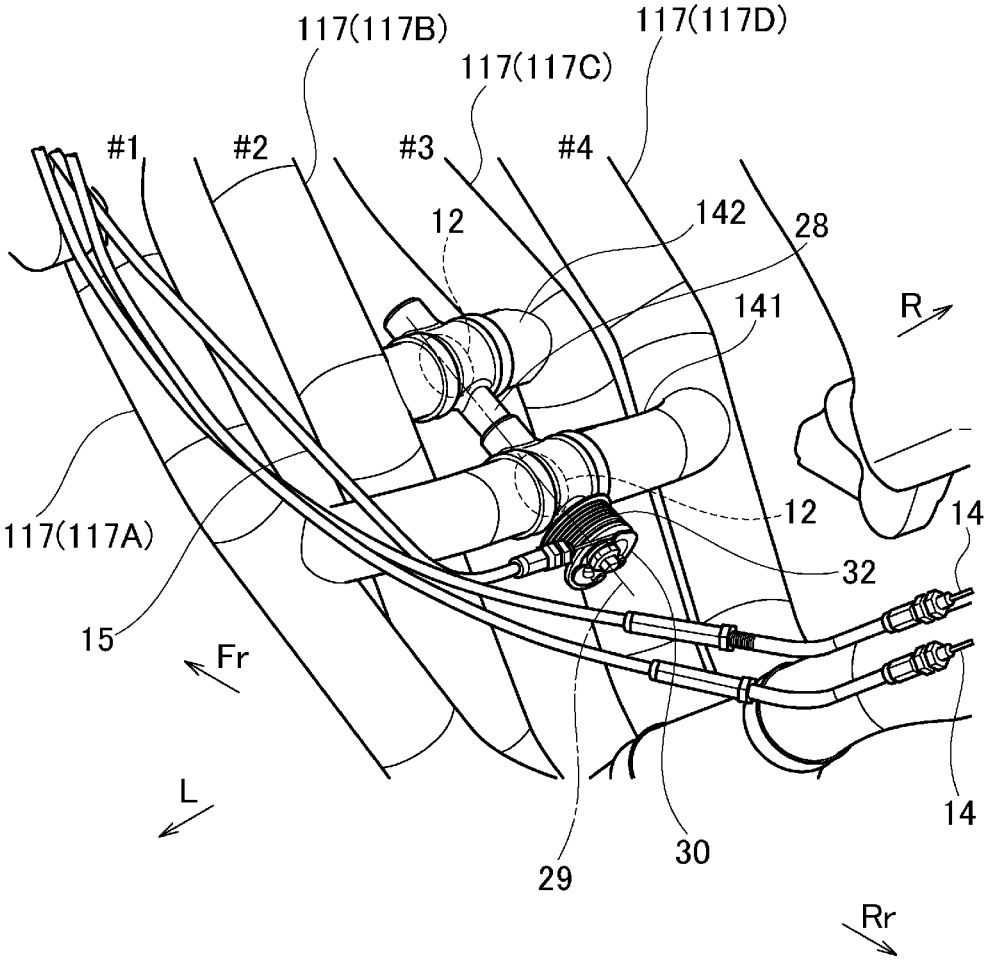
FIG. 5 is a perspective view illustrating examples of the control target of the exhaust control device in the embodiment of the present invention.

In this embodiment, parts to which the present invention is applied are the exhaust pipes 117 and the collecting pipe 139, and as concrete control targets, an exhaust pipe valve 11 (first exhaust pipe valve) is fit in the collecting pipe 139 as illustrated in FIG. 4, and exhaust pipe valves 12 (second exhaust pipe valves) are fit in the communication pipe 141 and the communication pipe 142 as illustrated in FIG. 5. Further, an actuator unit 13 which performs the exhaust control of these application parts is provided. In this example, by using the main frame 101, more concretely, the left main frame 101 as illustrated in FIG. 2, the actuator unit 13 is mounted on and supported by the main frame 101. As will be described later, the actuator unit 13 functions as an operation unit of the present invention which performs an opening/closing operation of the exhaust pipe valves 11, 12, and includes at least two operation parts which are connected to the plural exhaust pipe valves 11, 12 via wire cables 14, 15 respectively to open/close the exhaust pipe valves 11, 12. By driving the rotation of the exhaust pipe valve 11, it is possible to perform the opening/closing control of the collecting pipe 139, and by driving the rotation of the exhaust pipe valves 12, it is possible to perform the opening/closing control of the communication pipe 141 and the communication pipe 142.

Figure 6:
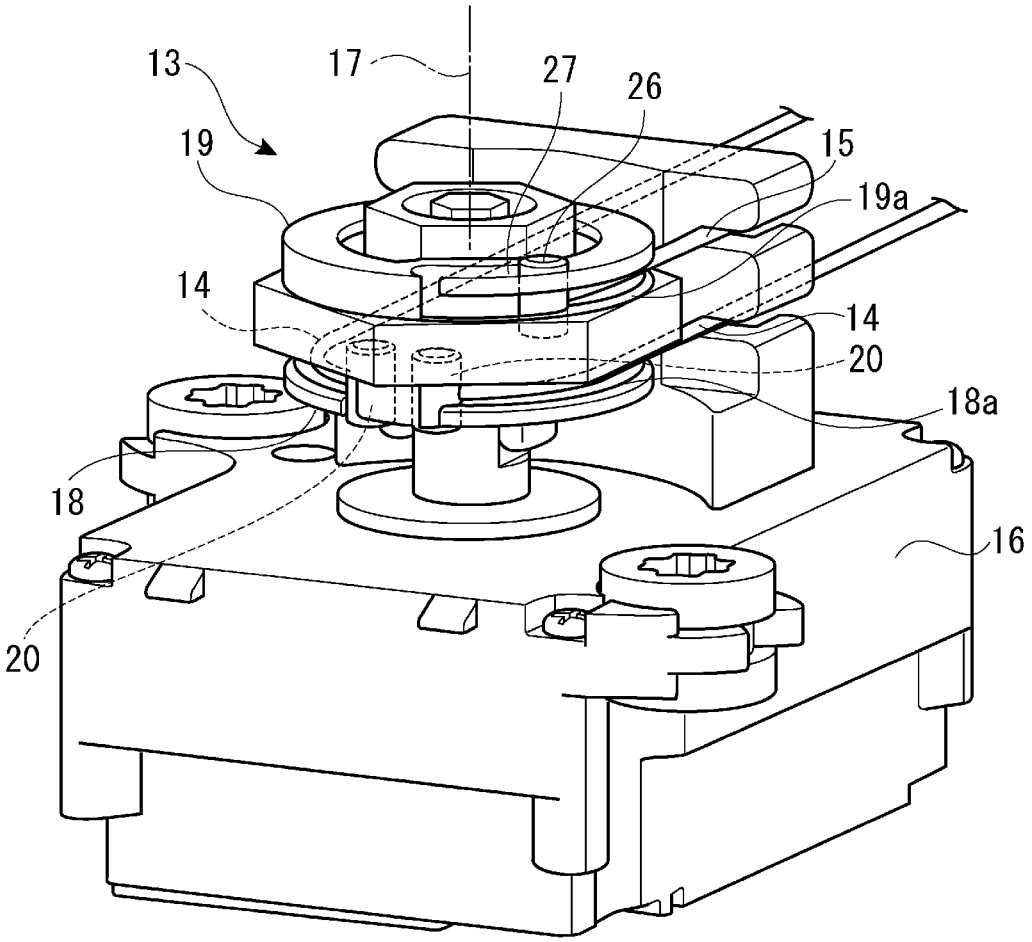
FIG. 6 is a perspective view of an actuator unit in the embodiment of the present invention.
Figure 7:
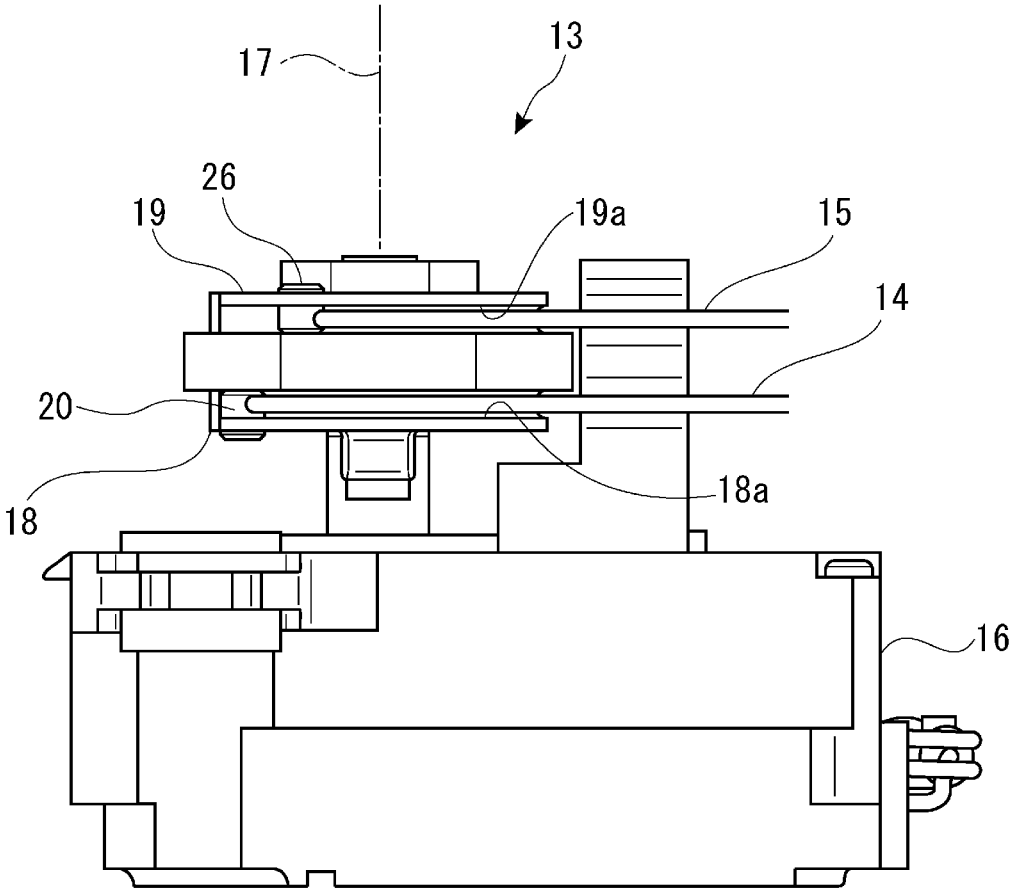
FIG. 7 is a side view of the actuator unit in the embodiment of the present invention.
Figure 8:
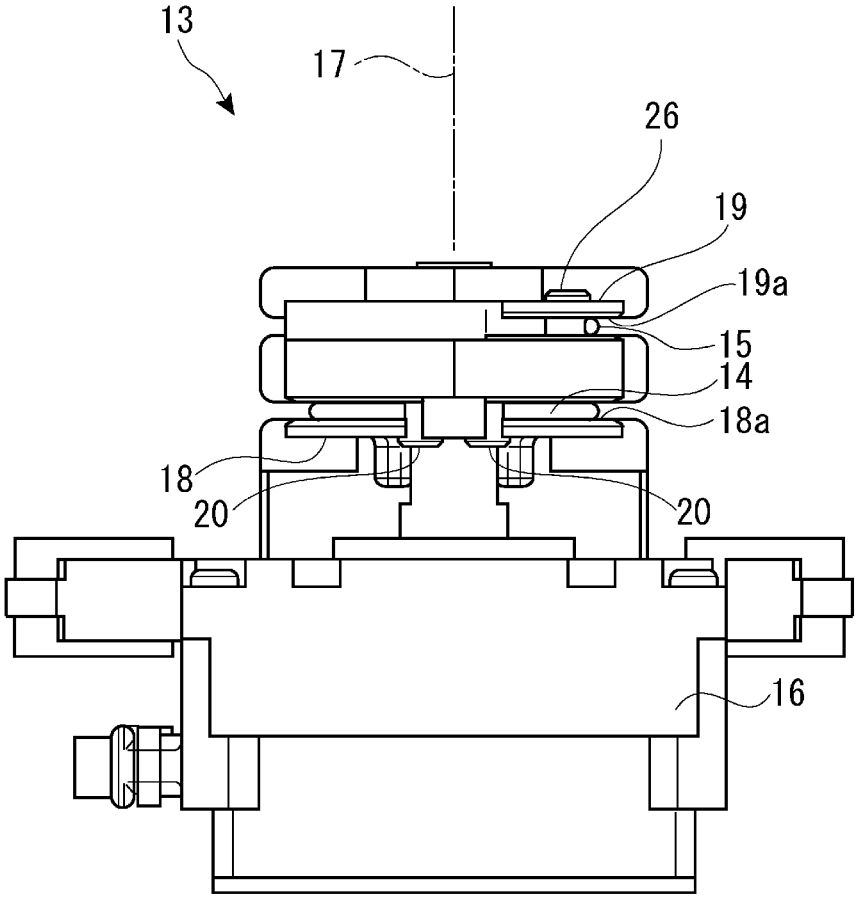
FIG. 8 is a front view of the actuator unit in the embodiment of the present invention.

Further, the actuator unit 13 will be concretely described. FIG. 6 is a perspective view of the actuator unit 13, FIG. 7 is a side view thereof, and FIG. 8 is a front view thereof. The actuator unit 13 has a first pulley 18 and a second pulley 19 which are supported on a main body 16 so as to be rotatable around a rotation shaft 17 and function as the operation parts of the present invention, and the wire cables 14, 15 are taken up on the first pulley 18 and the second pulley 19. Guide grooves 18*a*, 19*a* around which the wire cables 14, 15 are wound are formed in outer peripheral portions of the first pulley 18 and the second pulley 19 respectively. The main body 16 has, for example, a built-in stepping motor being a drive source, and an in-vehicle ECU controls the stepping motor in relation to an engine speed and the like. Consequently, the first pulley 18 and the second pulley 19 are driven to rotate at a predetermined timing, in a predetermined direction, and by a predetermined amount (angle).

Figure 9A:
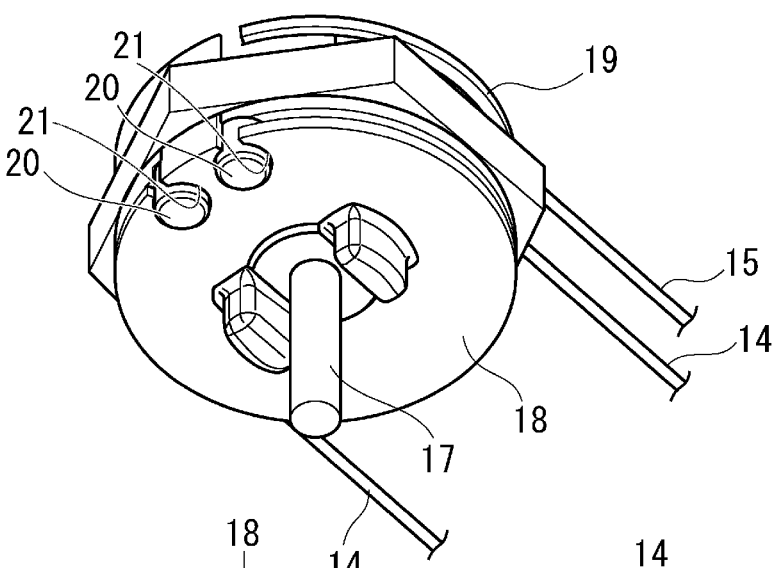
FIG. 9A is a perspective view illustrating operation parts according to the present invention.
Figure 9B:
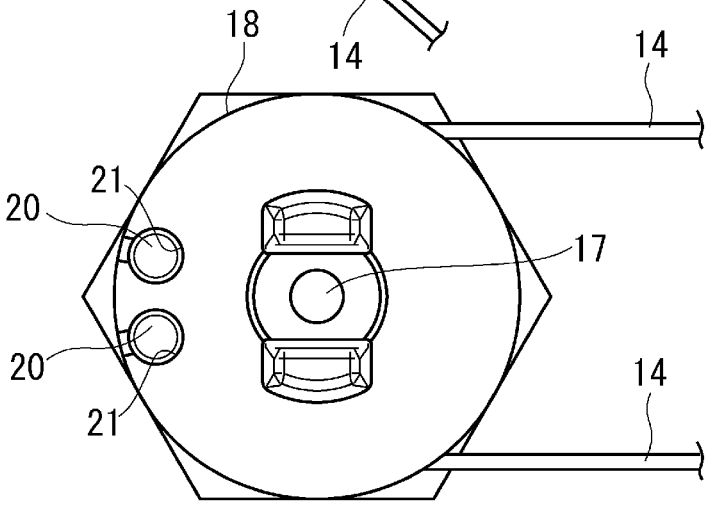
FIG. 9B is a bottom view illustrating the operation parts according to the present invention.

The wire cable 14 wound around the first pulley 18 is composed of a pair of two wires. In this case, as illustrated in FIG. 9A and FIG. 9B, terminals 20 of the wire cable 14 are held in hooking holes 21 of the first pulley 18 respectively. When one of the pair of two wires of the wire cable 14 is taken up, the other is reeled out.

The exhaust pipe valve 11 fit in the collecting pipe 139 is rotatably supported by a rotation shaft 22 as illustrated in FIG. 4. A driven pulley 23 is attached to one end side of the rotation shaft 22, though detailed illustration of the rotation shaft 22 is omitted. When the actuator unit 13 is actuated, the driven pulley 23 is controlled to rotate. Incidentally, the other terminals 24 of the wire cable 14 are held in hooking holes (not illustrated) of the driven pulley 23 as illustrated in FIG. 4. Further, a return spring 25 is attached to the driven pulley 23, and by its resilience, biases the rotation shaft 22 in a closing direction of the exhaust pipe valve 11.

Figure 9C:
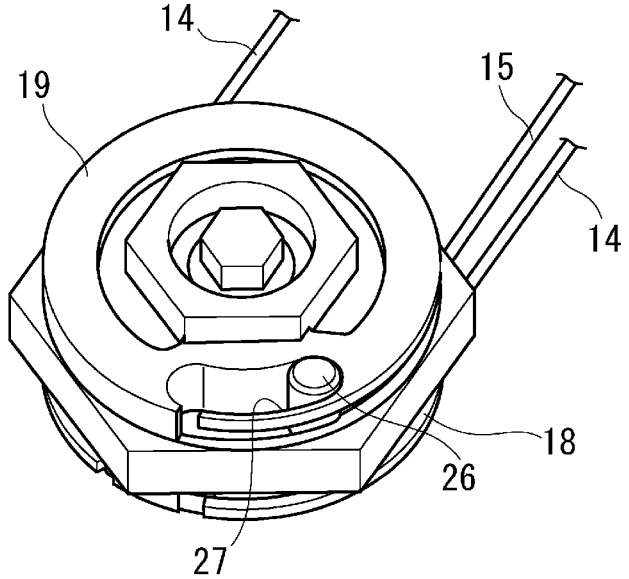
FIG. 9C is a perspective view illustrating the operation parts according to the present invention.

A terminal 26 of the wire cable 15 wound around the second pulley 19 is held in a hooking hole 27 of the second pulley 19 as illustrated in FIG. 9C. Here, the hooking hole 27 is formed as a long hole having a predetermined length along a circumferential direction of the second pulley 19, and the terminal 26 is relatively movable between both longitudinal end portions of the hooking hole 27.

The exhaust pipe valves 12 are fit in the communication pipe 141 and the communication pipe 142 as previously described, and further a coupling pipe 28 is provided between the communication pipe 141 and the communication pipe 142 as illustrated in FIG. 5, and a rotation shaft 29 is rotatably supported in the coupling pipe 28. The exhaust pipe valves 12 fit in the communication pipe 141 and the communication pipe 142 respectively are attached on the rotation shaft 29. That is, the two exhaust pipe valves 12 are coaxially disposed on and supported by the single rotation shaft 29 to operate at a synchronous timing. A driven pulley 30 is attached on one end side, in this example, on a communication pipe 141 side, of the rotation shaft 29, though detailed illustration of the rotation shaft 29 is omitted, and the driven pulley 30 is controlled to rotate by the actuation of the actuator unit 13. Incidentally, the other terminal 31 of the wire cable 15 is held in a hooking hole (not illustrated) of the driven pulley 30 as illustrated in FIG. 4. Further, a return spring 32 is attached to the driven pulley 30, and by its resilience, biases the rotation shaft 29 in a closing direction of the exhaust pipe valves 12.

Next, a concrete example of the exhaust control by the exhaust control device 10 in the exhaust pipe valve system of the present invention will be described. Here, in basic operations of the exhaust pipe valve 11 and the exhaust pipe valves 12, the smallest opening degree of the exhaust pipe valve 11 of the collecting pipe 139 at the engine start time is set to a predetermined opening degree. This smallest opening degree differs depending on the specifications of the engine or the like and has a certain degree of freedom. On the other hand, the exhaust pipe valves 12 are fully closed at the engine start time, and when the engine speed reaches a predetermined value after the engine starts, the exhaust pipe valves 12 are gradually opened.

Figures 10A, 10B, 10C:
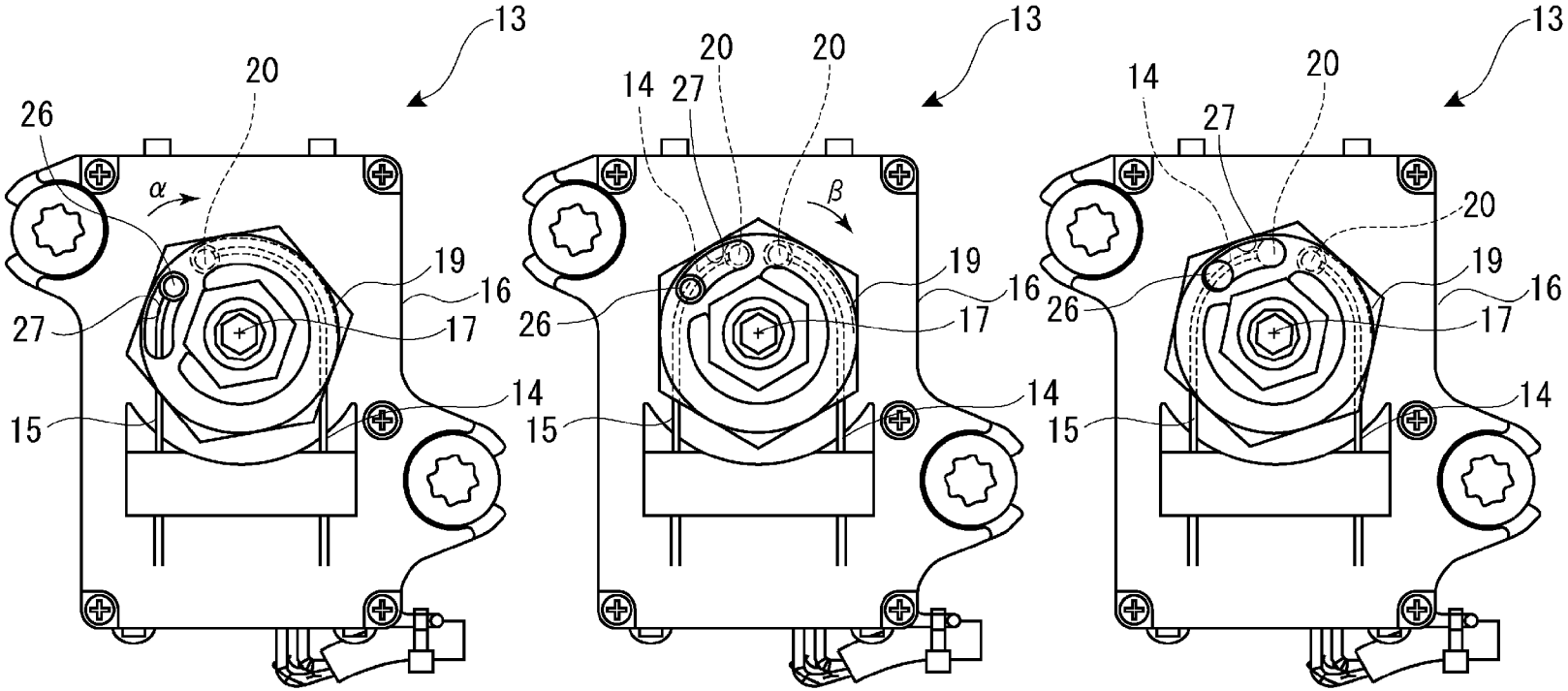
FIG. 10A is a view illustrating an operation example in a series of operations of the exhaust control device in the embodiment of the present invention.
FIG. 10B is a view illustrating an operation example in the series of operations of the exhaust control device in the embodiment of the present invention.
FIG. 10C is a view illustrating an operation example in the series of operations of the exhaust control device in the embodiment of the present invention.
Figure 11:
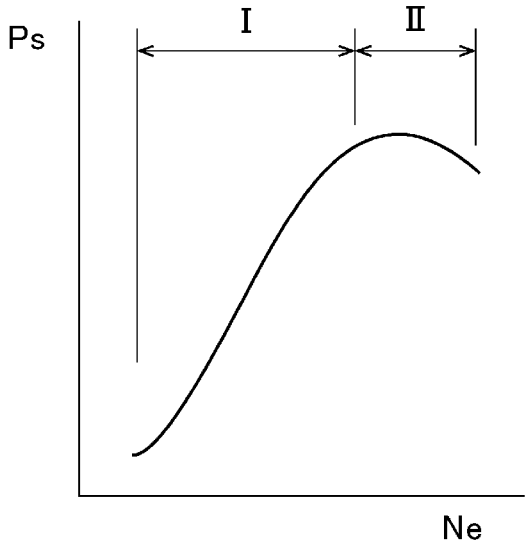
FIG. 11 is a chart illustrating a relation of an engine speed and a power characteristic or the like in the embodiment of the present invention.

After the engine starts, the rotation shaft 17 of the actuator unit 13 is driven, so that the first pulley 18 and the second pulley 19 both rotate in the arrow $\alpha$ direction (also means a rotation angle) as illustrated in FIG. 10A. In this embodiment, an engine power (PS) changes according to the engine speed (a low to middle-speed range I and a high-speed range II) (Ne) as in the example illustrated in FIG. 11, for instance. The actuator unit 13 is driven according to such an engine power characteristic, so that the exhaust pipe valves 11, 12 are opened/closed. When the engine rotation is in the low to middle-speed range I, the exhaust pipe valve 11 is rotated by the rotation of the first pulley 18 via the wire cable 14, from the initial smallest opening degree by the angle $\alpha$ to be fully opened, that is, its opening degree becomes 100%.

During this period, the terminal 26 of the wire cable 15 is substantially static in the hooking hole 27 of the second pulley 19, and after the first pulley 18 and the second pulley 19 rotate by the angle $\alpha$, the terminal 26 abuts on one end side of the hooking hole 27 (rear side in terms of the rotation direction of the second pulley 19) as illustrated in FIG. 10B. The rotation shaft 17 of the actuator unit 13 is further driven, so that the first pulley 18 and the second pulley 19 both rotate from this state in the arrow $\beta$ direction (also means the rotation angle). When the engine rotation reaches the high-speed range II, the exhaust pipe valves 12 start to be opened by the rotation of the second pulley 19 via the wire cable 15, while the exhaust pipe valve 11 is kept fully open, as illustrated in FIG. 10C.

In the present invention, the first pulley 18 being one of the operation parts constantly causes the wire cable 14 to work in the whole operating range of the actuator unit 13. As for the second pulley 19 being the other operation part, its connection to the wire cable 15 is cut off in a predetermined operating range (angle $\alpha$) of the actuator unit 13, that is, has a non-operating area in which the second pulley 19 does not cause the wire cable 15 to work.

As described above, according to the present invention, it is possible to easily and accurately control the exhaust pipe valves, in this example, the two kinds of exhaust pipe valves 11, 12 stepwise, without providing any special operation control over the operation unit or any stopper mechanism for limiting the operation of a specific operation part, or the like. This makes it possible to adjust an exhaust flow rate to an appropriate amount at an appropriate time even with the simple structure, to effectively improve a combustion state in the engine, which enables improvements of the power, fuel performance, and the like. Further, since it is possible to operate the plural exhaust pipe valves 11, 12 by the single actuator unit 13, the number of components of the device is reduced, which has effects such as improving maintenability, productivity, and so on.

As described above, the opening degrees of the exhaust pipe valves 11, 12 are controlled according to the engine speed. An opening/closing speed when the exhaust pipe valves 11, 12 are opened/closed can be appropriately adjusted to low or high by the driving control of the stepping motor of the actuator unit 13. Further, especially a size (length), a position, and so on of the hooking hole 27 of the second pulley 19 can be appropriately changed, and in this example, the opening/closing timing and so on of the exhaust pipe valves 12 can be set as required.

Hitherto, the present invention has been described together with the various embodiments, but the present invention is not limited only to these embodiments, and changes and so on can be made therein within the scope of the present invention.

In the above-described embodiment, the case where the two kinds of exhaust pipe valves 11, 12 are controlled as the control targets, but by further providing a third and a fourth pulley which have the same structure as above, it is also possible to set a third and a fourth control target.

Further, the exhaust control device of the present invention is also applicable to a multi-cylinder engine having two cylinders or four cylinders or more.

According to the present invention, the exhaust pipe valves being the control target parts whose opening/closing is to be controlled are not controlled independently, but they are controlled by the single actuator. This reduces the number of components of the device, which can simplify the device structure and realize a cost reduction.

What is claimed is:

1. An exhaust pipe valve system of an internal combustion engine which adjusts an exhaust flow rate in an exhaust pipe by opening and closing an exhaust pipe valve provided in a middle part of the exhaust pipe, the exhaust pipe valve system comprising:

a plurality of the exhaust pipe valves comprising:

at least a first exhaust pipe valve connected to a first wire cable; and a second exhaust pipe valve connected to a second wire cable; and a plurality of pulleys comprising:

at least a first pulley, opening and closing the first exhaust pipe valve, connected to the first wire cable; and a second pulley comprising a long hole formed in the second pulley and along a circumferential direction of the second pulley, wherein a terminal of the second wire cable is held in the long hole, wherein when the second pulley is rotated a predetermined angle range, the terminal of the second wire cable moves relative to the second pulley along the long hole, and wherein when the second pulley is rotated beyond the predetermined angle range, the second pulley causes the second wire terminal to abut against an end portion of the long hole and further moves the second pulley to open and close the second exhaust pipe valve connected to the second wire cable.

2. The exhaust pipe valve system of the internal combustion engine according to claim 1, wherein a terminal of the first wire cable is fixed to the first pulley.

3. The exhaust pipe valve system of the internal combustion engine according to claim 1, wherein the first pulley and the second pulley are supported so as to be rotatable around a rotation shaft which is rotated by an electric motor.

* * * * *